United States Patent [19]

Sakata et al.

[11] 4,442,682

[45] Apr. 17, 1984

[54] TURBINE FOR USE IN REFRIGERATION CYCLE

[75] Inventors: Hirotsugu Sakata, Chigasaki; Shigemi Nagatomo, Tokyo; Takashi Matsuzaka, Fuji, all of Japan

[73] Assignee: Tokyo Shibaura Denki Kabushiki Kaisha, Kawasaki, Japan

[21] Appl. No.: 421,773

[22] Filed: Sep. 23, 1982

[30] Foreign Application Priority Data

Sep. 30, 1981 [JP] Japan ..... 56-155184

[51] Int. Cl.[3] ..... F25D 9/00

[52] U.S. Cl. ..... 62/401; 62/500; 62/512; 415/203

[58] Field of Search ..... 62/116, 500, 512, 401; 415/202, 203

[56] References Cited

U.S. PATENT DOCUMENTS 2,519,010 8/1950 Zearfoss, Jr. ..... 62/116

3,077,087 2/1963 Japhet ..... 62/500

4,304,104 12/1981 Grose ..... 62/500

FOREIGN PATENT DOCUMENTS 50-128243 10/1975 Japan .

55-160259 5/1979 Japan .

*Primary Examiner*—Ronald C. Capossela

*Attorney, Agent, or Firm*—Oblon, Fisher, Spivak, McClelland & Maier

[57] ABSTRACT

A turbine for use in refrigeration cycle comprising a closed casing, a turbine runner housed in said casing, an injection nozzle through which refrigerating medium having at least one of pressure-based and knetic energies is blown to rotate the turbine runner, a liquid refrigerating medium receiving section arranged at the lower end of said casing to collect liquid refrigerating medium, and a refrigerating medium discharging outlet through which refrigerating medium is fed to an evaporator arranged in a refrigeration cycle.

7 Claims, 7 Drawing Figures

TURBINE FOR USE IN REFRIGERATION CYCLE

BACKGROUND OF THE INVENTION

The present invention relates to a turbine for use in refrigeration cycle, particularly capable of increasing turbine output without reducing the capacity of refrigeration cycle.

Turbines for use in refrigeration cycle have become popular. Refrigerating medium compressed by the compressor is fed to the condenser in the course of usual refrigeration cycle. The refrigerating medium is liquidized here, introduced through the capillary tube or expansion valve into the evaporator, and fed to the compressor after having passed through the evaporator. The refrigerating medium passed through the capillary tube or expansion valve in this refrigeration cycle is caused to have large kinetic energy because energy charged due to high pressure is released. Paying attention to the fact that the refrigerating medium has such kinetic energy as described above, a system has been realized in which a turbine is driven by said refrigerating medium of large kinetic energy and turbine output thus obtained is used to reduce total power consumption. The turbine used to this end is connected between the capillary tube (or expansion valve) and the evaporator. The turbine has a turbine runner freely rotatable in a casing and this turbine is driven by said refrigerating medium of large kinetic energy.

The conventional turbine used as described above in a refrigeration cycle comprises a space formed inside the casing with its central axis directed horizontally, the turbine runner supported in the space with its rotary shaft directed horizontally, an inlet provided in the circumferential wall of said casing and through which the refrigerating medium to be blown to the turbine runner is introduced, and an outlet provided in the circumferential wall of said casing and through which the refrigerating medium is discharged. These conventional turbines, however, had some following points to be improved. The refrigerating medium for driving the turbine runner is usually blown to the turbine runner under gas-liquid-mixed state and separated due to the difference of specific gravity into the liquid part falling downward and the gas part rising upward. This refrigerating liquid is gathered on the bottom of said casing and becomes so high in level as to immerse the lower portion of said turbine runner. When the turbine runner is rotated with its lower portion immersed in the refrigerating liquid in the casing, power is needed to overcome the friction caused between the turbine runner and the refrigerating liquid. This power is a loss at the time of driving the turbine runner and turbine output is therefore reduced by this loss. When the refrigeration cycle is ceased, the refrigerating medium in the cycle forms a mass in each of low temperature portions and the refrigerating liquid collected on the bottom of said casing often becomes so high in level as to immerse the lower portion of the turbine runner as each section of said refrigeration cycle is cooled. When the refrigeration cycle is started under this state, large starting force is needed, the time during which the turbine runner is started and reaches its steady state revolution becomes long, during which the refrigerating medium is stirred by the turbine runner, making its flow unstable and therefore causing a loss in its flow, and input power necessary to drive the compressor must be increased. It is preferable that the refrigerating medium passing through the turbine changes under equal entropy state, but the refrigerating medium usually moves in a direction in which said entropy increases. Namely, the dryness fraction of refrigerating medium becomes high and gas irrelevant to refrigerating capacity increases. When the refrigerating medium of this state is fed to the evaporator, pressure loss is increased because of the presence of the gas in the evaporator and the efficiency of whole refrigeration cycle is reduced. When considering the whole of refrigeration cycle, therefore, power consumption necessary to operate said refrigeration cycle could not be sufficiently reduced even in view of mechanical power obtained from the turbine.

Above described problem is occurred when the turbine is connected between the condenser and the capillary tube, or when the capillary tube is formed with a series connected two tubes and the turbine is provided between the two capillary tubes.

SUMMARY OF THE INVENTION

The object of the present invention is to provide a turbine for use in refrigeration cycle for generating a high rotation output without lowering the performance of the cycle, and for realizing a refrigeration cycle of high cooling capacity with low power consumption by utilization of the turbine output to the refrigeration cycle.

According to the turbine for use in refrigeration cycle provided by the present invention to this end, a refrigerating liquid receiving section is provided at the lower portion of a casing and a first outlet is arranged through which refrigerating liquid is fed from the receiving section to an evaporator. It is preferable that the volume of said receiving section corresponds to the whole of refrigerating medium contained in a closed loop which forms the refrigeration cycle. When the construction and arrangement of each section of said refrigeration cycle are appropriate and said refrigerating liquid is distributed to each section not to gather in the lower portion of said casing at the time of intermittent stops, however, the volume of said receiving section can be made smaller depending upon the volume of refrigerating liquid gathered.

The turbine according to the present invention and provided with the refrigerating liquid receiving section can prevent its turbine runner from contacting with the refrigerating liquid even in the course of operation as well as at the time of starting said refrigeration cycle, thus allowing the cycle to pass smoothly to the stationary operation and loss also to be reduced in the course of operation, so that large rotation output can be obtained from the turbine without affording any influence to said refrigeration cycle. When the refrigeration cycle according to the present invention is employed, stabilization of refrigeration cycle, enhancement of efficiency, reduction of power consumption and increase of turbine output can be achieved.

According to a preferable embodiment of the present invention, another outlet or second outlet is provided at a portion of the casing above the refrigerating liquid receiving section and communicating with a space inside the casing, and serves to feed refrigerating gas present in said portion not to the evaporator but directly to the refrigeration cycle down the evaporator. Since the refrigerating gas is not supplied to the evaporator, that is, gas having no cooling capacity is not passed through the evaporator as described above, pressure loss in the evaporator can be reduced. A refrigeration cycle can also be formed by connecting capillary tubes to the refrigeration cycle up and down the turbine and communicating the second outlet with the inside of a cylinder which is compressing the gaseous refrigerating medium so that the gaseous refrigerating medium in the casing may be forced into the cylinder. When the two refrigeration cycles using the second outlet is employed, the amount of refrigerating medium circulated to contribute cooling capacity can be increased to further enhance the efficiency of refrigeration cycle, reduce power consumption and enhance turbine output.

DETAILED DESCRIPTION OF THE PREFERRED EMBODIMENT

Figure 1:
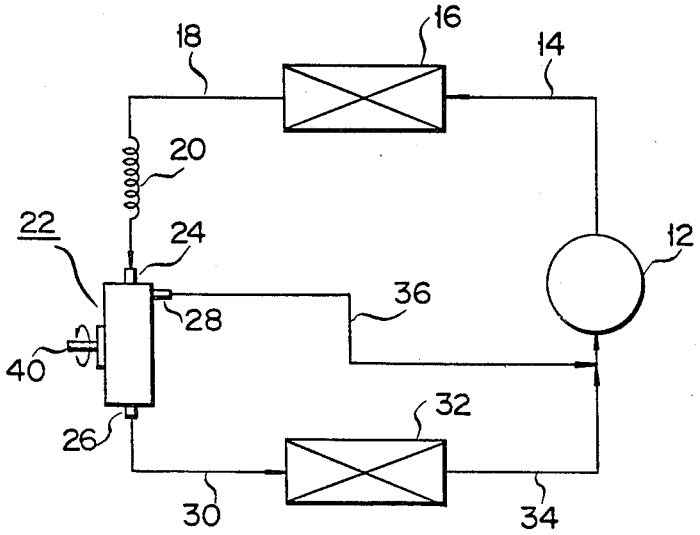
FIG. 1 is a block diagram showing a refrigeration cycle in which a turbine according to the present invention is employed.
Figure 3:
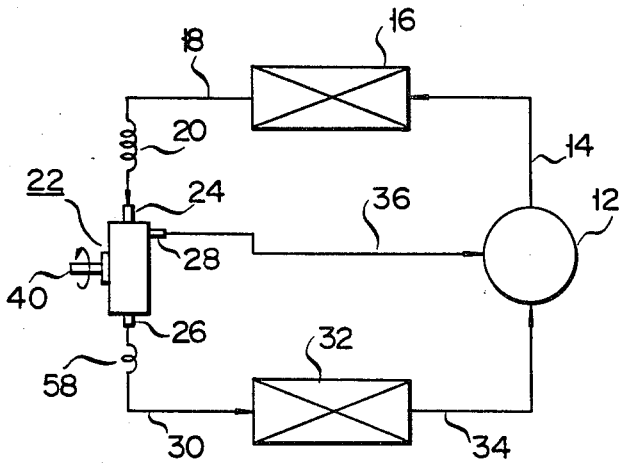
FIG. 3 is a block diagram showing another refrigeration cycle in which the refrigeration cycle turbine according to the present invention is employed.

An embodiment of the present invention will be now described. FIG. 1 is a block diagram showing a refrigeration cycle in which a turbine of the present invention is employed. Numeral 12 represents a compressor for compressing refrigerating medium. The refrigerating medium is fed from the compressor 12 to a condenser 16 via a pipe 14 and liquidized in the condenser 16. The refrigerating medium liquidized is supplied to a turbine 22 of the present invention through a pipe 18 and a capillary tube 20. The position of the turbine 22 is not limited to the position described above. The turbine 22 may be connected between the refrigerator 16 and capillary tube 20, as well as connected between two capillary tubes 20 and 58 as shown in FIG. 3. The turbine is provided with a refrigerating medium introducing section 24, which will be described later, a first refrigerating medium outlet 26 and a second refrigerating medium outlet 28. The refrigerating medium fed through the first outlet 26 is introduced into an evaporator 32 through a pipe 30 and discharged through a pipe 34. The refrigerating medium fed through the second outlet 28 is discharged through a pipe 36 in a state of predetermined low pressure. If necessary, pipe 36 may include a capillary tube (not shown). Both of the pipes 34 and 36 are communicated with the suction inlet of said compressor 12 and refrigerating media fed through said evaporator 32 and second outlet 28 are sucked into the compressor 12.

Figure 2:
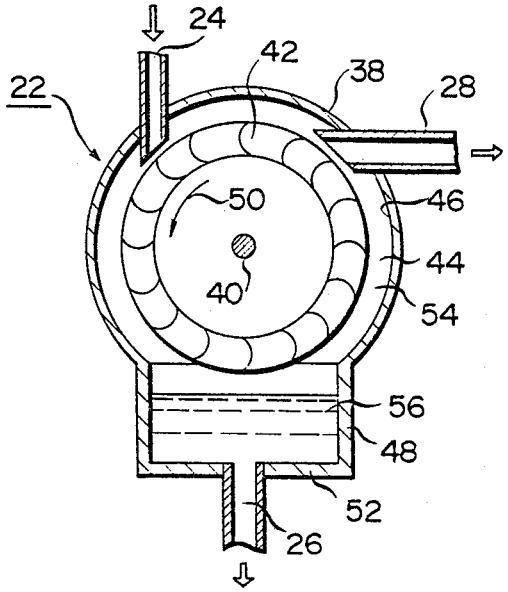
FIG. 2 is a sectional view showing an example of refrigeration cycle turbine according to the present invention and taken along a plane perpendicular to the rotation shaft of said turbine.

FIG. 2 shows a turbine 22 wherein a turbine runner 42 having a rotation shaft 40 air-tightly passed through and projected outside from a casing 38 is supported with its rotating shaft 40 directed horizontally in a space 44 formed inside the casing 38. If necessary, the turbine is formed with the rotation shaft 40 directed vertically. The casing 38 has a circumferential wall 46 substantially coaxial to the turbine runner 42 and a refrigerating medium receiving section 48 arranged at the lower end thereof and in communication with the space 44 to receive liquid refrigerating medium.

The injection nozzle or refrigerating medium introducing section 24 is arranged at an upper portion of said casing 38, penetrating through the circumferential wall 46 from outside into a ring-shaped space 54 formed between the circumferential wall 46 and the turbine runner 42, and the refrigerating medium is blown through the injection nozzle 24 to drive the turbine runner 42 in a direction shown by an arrow 50. The pipe or first refrigerating medium outlet 26 is provided in the bottom 52 of said refrigerating medium receiving section 48 arranged at the lower end of said casing 38, and connected to the pipe 30. The discharge nozzle or second refrigerating medium outlet 28 is arranged at an upper portion of said ring-shaped space 54, penetrating through the outer circumferential wall 46 from outside into the space 54, and connected to the pipe 36.

When the refrigeration cycle is carried out using the turbine 22 arranged as described above, refrigerating medium is fed from the compressor 12, liquidized through the condenser 16 and supplied to the turbine 22 via the capillary tube 20. The refrigerating medium is divided into two parts, one returning to the compressor 12 through the evaporator 32 while the other being fed directly to the compressor 12 through the second outlet 28.

The refrigerating medium of high pressure supplied to the turbine 22 through the capillary tube 20 is converted to a state of low pressure and high speed, and blown to the turbine runner 42 through the refrigeration medium introducing section or injection nozzle 24, causing the turbine runner 42 to rotate in the direction of arrow 50. When the capillary tube is connected between the turbine 22 and evaporator 32, the high pressure refrigerating medium from the condenser 16 is blown to the turbine runner 42 through the injection nozzle 24. And when the turbine 22 is connected between two capillary tubes 20 and 58 as shown in FIG. 3, high pressure refrigerant medium from condenser 16 is converted to a refrigerant medium flow of certain pressure and speed and blown to the turbine 42 through the injection nozzle 24. The refrigerating medium injected through the injection nozzle 24 as described above becomes a mixture of gaseous and liquid refrigerating media. Therefore, the refrigerating medium having heavy specific gravity is collected in the refrigerating medium receiving section 48 and continuously fed to the evaporator 32 through the first outlet 26. The other refrigerating medium or gaseous refrigerating medium is supplied to the compressor 12 through the second outlet or exhaust tube 28 and pipe 36.

The refrigerating medium receiving section 48 is provided in the turbine 22 while the first outlet 26 for discharging the liquid refrigerating medium is provided in the receiving section 48, and the liquid refrigerating medium is continuously discharged through the outlet 26 during the refrigeration cycle. When the volume of said receiving section 48 is appropriately selected, therefore, the level of said liquid refrigerating medium 56 in the receiving section 48 can be kept constant so as to prevent said liquid refrigerating medium from contacting with the turbine runner 42. Loss caused by the contact between the turbine runner 42 and the liquid refrigerating medium 56 can be thus prevented and larger rotation output can be obtained by the turbine 22 as compared with a case where the turbine runner 42 is brought into contact with the liquid refrigerating medium 56, providing that same driving energy is applied to the turbine 22. When the refrigeration cycle is started, therefore, the turbine runner 42 is allowed to quickly start its rotation, thus making it unnecessary to increase input applied to the compressor, which was needed because of the delay of rotation start in the case of conventional turbines, and making it possible to shorten the unstable operation time during which the refrigeration cycle becomes steady. Even if the volume of refrigerating medium sealed in the closed loop has some degrees of error and the operation state of refrigeration cycle is changed by external causes, the refrigerating medium receiving section 48 provided can reduce these influences. Since the first outlet 26 for discharging the liquid refrigerating medium only and the exhaust tube 28 for discharging the gaseous refrigerating medium only are provided in the casing 38, the gaseous refrigerating medium having no cooling capacity can be prevented from entering into the evaporator 32 when the exhaust tube 28 is connected through the pipe 36 to the pipe 34 down the evaporator 32, as shown in FIG. 1. As the result, pressure loss caused in the evaporator 32 can be reduced and load applied to the compressor 12 becomes small, thus enabling input applied to the compressor 12 to be reduced and power consumption to be saved all over the refrigeration cycle.

Figure 4:
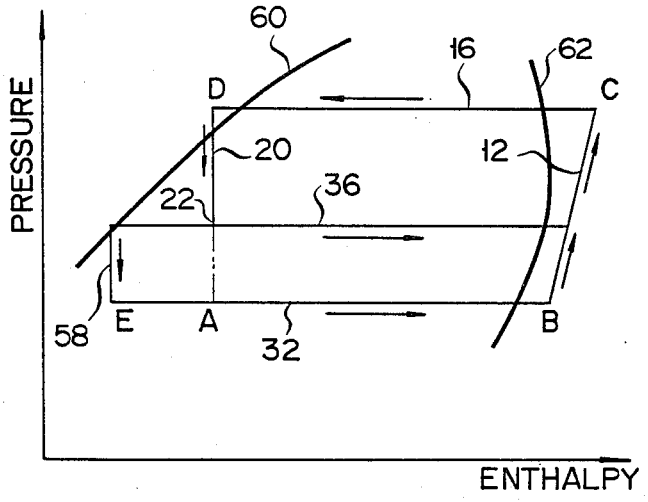
FIG. 4 is a Mollier diagram of said refrigeration cycle shown in FIG. 3.

FIG. 3 shows another example of refrigeration cycle in which the turbine of the present invention is employed. This refrigeration cycle is substantially similar to the one shown in FIG. 1 but different in that a capillary tube 58 is arranged between the turbine 22 and the evaporator 32 and that the gaseous refrigerating medium fed through the exhaust tube 28 is supplied to the cylinder of said compressor 12 which is in compression process. If the refrigeration cycle shown in FIG. 3 is employed, the following effects can be achieved in addition to those attained by the refrigeration cycle shown in FIG. 1 and already described above. When properties of capillary tubes 20 and 58 are appropriately selected, pressure in the space 44 of said turbine 22 which is arranged between these two capillary tubes is raised to force the gaseous refrigerating medium in the space 44 into the cylinder of said compressor 12 which is in compression process. Therefore, Mollier diagram of each of sections which form the refrigeration cycle becomes as shown in FIG. 4, and the volume of refrigerating medium having cooling capacity can be increased, that is, cooling capacity can be enhanced to thereby reduce the power consumption. In the Mollier diagram of FIG. 4, numeral 60 represents a saturated liquid curve, 62 a saturated vapor curve, and a straight line denoted by numeral 16 shows how pressure and enthalpy of refrigerating medium in the condenser 16 change. Similarly, straight lines denoted by numerals 12, 20, 22, 32, 36 and 58 show changes of pressure and enthalpy of said refrigerating medium passing through the compressor 12, capillary tube 20, turbine 22, evaporator 32 and pipe 36. In a case where the capillary tube 58 is not employed and the gaseous refrigerating medium is not forced into the compressor 12, the Mollier diagram will be represented by a rectangle formed by combining points A, B, C and D, providing that the point at which the extended line 20 crosses the line 32 is denoted by A. Therefore, refrigerating effects attained by refrigeration cycles shown in FIGS. 1 and 3 are represented by lines AB and EB, respectively. The increase of refrigerating capacity as described above will be apparent from the Mollier diagram shown in FIG. 4.

Figure 5:
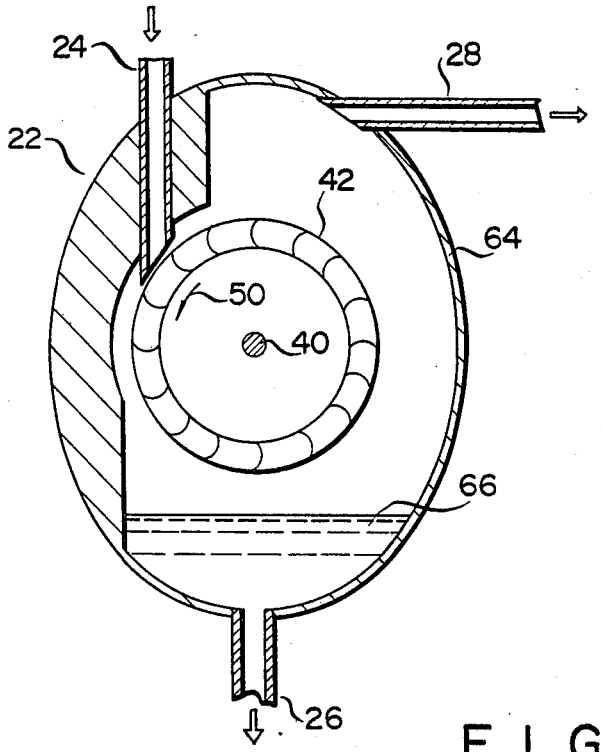
FIGS. 5 and 6 are sectional views showing two variations of refrigeration cycle turbines.
Figure 6:
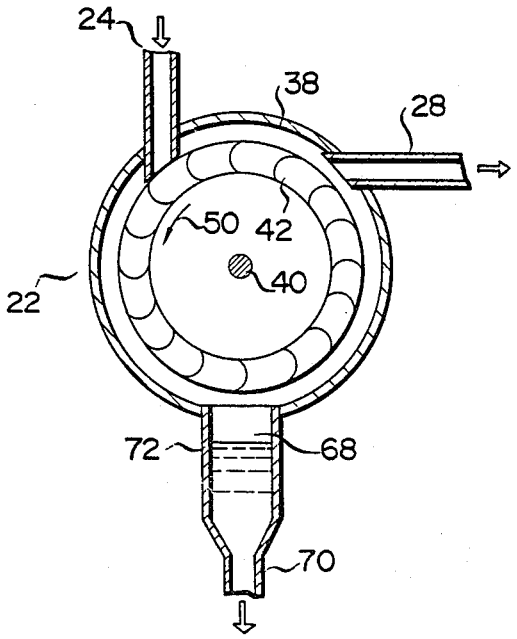

It should be understood that the turbine of the present invention is not limited to the one shown in FIG. 2 but may be modified to a variety of versions. Although the casing 38 of circular section from which its lower end is removed and which is provided with the liquid refrigerating medium receiving section instead is employed in the above described embodiment, a casing 64 of oval section is arranged with its longitudinal axis directed vertically, as shown in FIG. 5, and a relatively large valley 66 formed on the bottom side of said casing 64 and between the casing 64 and the turbine runner 42 may be used as the liquid refrigerating medium receiving section 48 in FIG. 2. Or the casing 38 shown in FIG. 2 is made larger and the turbine runner 42 is arranged eccentric above the center of said casing 38, and a space thus formed on the bottom side of said casing 38 and between the casing 38 and the turbine runner 42 may be used as the liquid refrigerating medium receiving section 48. Or the casing 38 is formed to have a circular section, and a pipe-like liquid refrigerating medium receiving section 68 provided with a pipe-like portion 72 having a relatively larger diameter and a discharging pipe 70 communicated with the lower end of said pipe-like portion 72 and connected to the pipe 30 may be sealingly and detachably attached, instead of said receiving section 48 of FIG. 2, to the lower end of said casing 38, as shown in FIG. 6. The volume in which the liquid refrigerating medium can be contained can be varied by appropriately selecting the length of said larger-diameter pipe-like portion 72 in this case. Therefore, the main portion of turbine can be used as it is, satisfying any changes in liquid refrigerating medium containing volume which are needed by differences in the kind of refrigeration cycles, their capacities, arrangement of various component devices for achieving refrigeration cycles, and arrangement of pipes.

Figure 7:
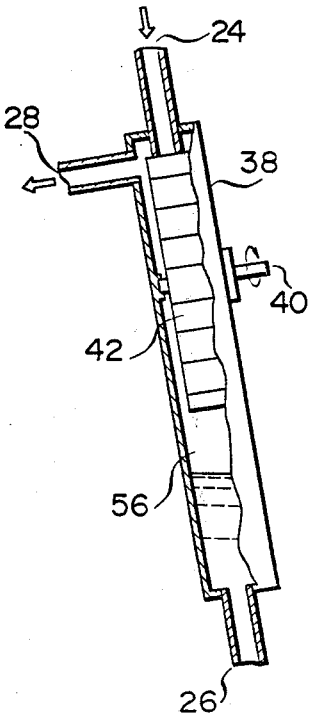
FIG. 7 is a side view, partly sectioned, showing a position of a turbine when it is being used.

Although the rotation shaft 40 of each of turbine runners 42 shown in FIGS. 2, 5 and 6 is arranged horizontal, it is not necessary that the turbine takes this position only, when it is used to carry out refrigeration cycle. As shown in FIG. 7, for example, the turbine may be slanted to such an extent that the lower end of outer circumference of said turbine runner 42 is not immersed in the liquid refrigerating medium 56 to stir said refrigerating medium 56. In the case where the turbine 22 of the present invention is employed to carry out the refrigeration cycle shown in FIG. 3, the exhaust tube 28 may be connected through a capillary tube to the suction inlet of said compressor 12, if necessary.

Embodiments of refrigeration cycle turbines according to the present invention and refrigeration cycles in which each of these embodiments is employed have been described. It will be apparent from the above that any of said turbines according to the present invention enables power consumption for driving the refrigeration cycle to be reduced, the enhancement of refrigerating capacity to be achieved and large rotation output to be obtained.

What is claimed as new and desired to be secured by Letters Patent of the United States is:

1. A turbine for use in refrigeration cycle comprising:

a casing having an inner circumferential wall to define a closed space;

a turbine runner housed freely rotatable in the space of said casing;

an injection nozzle through which refrigerating medium having at least one of pressure-based energy and kinetic energy is introduced into the casing to blow upon and rotate the turbine runner;

a liquid refrigerating medium receiving section arranged at the lower end of said casing to collect liquid refrigerating medium;

a first liquid refrigerating medium discharging outlet through which the liquid refrigerating medium collected in said receiving section is fed to an evaporator arranged in the refrigeration cycle; and a second refrigerating medium discharging outlet communicated with the space in said casing above the liquid refrigerating medium receiving section and feeding gaseous refrigerating medium present in said space above the receiving section to the refrigeration cycle at a point downstream from said evaporator.

2. A turbine according to claim 1 wherein said receiving section is a part of a space formed between the outer circumferential wall of said turbine runner and the inner circumferential wall of said casing.

3. A turbine according to claim 1 wherein said receiving section is a part of a space formed by the inner circumferential wall of said casing and the outer circumferential wall of said turbine runner, which is arranged eccentric to the inner circumferential wall of said casing.

4. A turbine according to claim 1 wherein said receiving section is arranged projecting from the lower end of said casing.

5. A turbine according to claim 1, wherein said second outlet is connected to a refrigerating medium flow path which communicates with a cylinder of a compressor which is connected in series to said evaporator.

6. A turbine according to claim 5, wherein said second outlet is connected to a pipe which is connected to a point between said compressor and said evaporator.

7. A turbine according to claim 5, wherein said second outlet is connected to said cylinder of said compressor.

* * * * *